US008229341B2

(12) United States Patent
Dergham et al.

(10) Patent No.: US 8,229,341 B2
(45) Date of Patent: Jul. 24, 2012

(54) WASTE CYCLONE DISPENSE SYSTEM WITH A CONTROLLED GATE

(75) Inventors: Ali R. Dergham, Fairport, NY (US); Timothy M. Davis, Macedon, NY (US); Jorge M. Rodriguez, Webster, NY (US); Randall E. Kaufman, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 403 days.

(21) Appl. No.: 12/572,334

(22) Filed: Oct. 2, 2009

(65) Prior Publication Data

US 2011/0081179 A1 Apr. 7, 2011

(51) Int. Cl.
*G03G 21/10* (2006.01)

(52) U.S. Cl. ..... 399/358

(58) Field of Classification Search ..... 399/358, 399/360, 257
See application file for complete search history.

(56) References Cited

U.S. PATENT DOCUMENTS

| | | | | |
|---|---|---|---|---|
| 5,260,755 | A * | 11/1993 | Imaizumi | |
| 7,054,591 | B1 * | 5/2006 | Wilhelm et al. | 399/360 |
| 7,209,680 | B2 * | 4/2007 | Kweon | |
| 7,509,086 | B2 * | 3/2009 | Shirai | 399/358 |
| 7,657,211 | B2 * | 2/2010 | Kawai | 399/358 |
| 2005/0169649 | A1 * | 8/2005 | Onodera et al. | |
| 2005/0232669 | A1 * | 10/2005 | Ishikawa et al. | 399/358 |
| 2008/0118290 | A1 * | 5/2008 | Sato | 399/358 |
| 2009/0022532 | A1 * | 1/2009 | Fukunaga et al. | 399/360 |
| 2009/0154972 | A1 * | 6/2009 | Tanaka et al. | 399/358 |
| 2011/0081178 | A1 * | 4/2011 | Dergham et al. | 399/358 |
| 2011/0081180 | A1 * | 4/2011 | Rodriguez et al. | 399/358 |

FOREIGN PATENT DOCUMENTS

| | | | |
|---|---|---|---|
| JP | 61059470 A | * | 3/1986 |
| JP | 04116583 A | * | 4/1992 |

* cited by examiner

*Primary Examiner* — Susan Lee
(74) *Attorney, Agent, or Firm* — Ronald E. Prass, Jr.; Prass LLP

(57) ABSTRACT

This is a waste cyclone toner dispense system with a controlled gate and a collection bag below the gate. The controlled gate is configured to be opened and closed at a predetermined time thereby permitting the use of relatively inexpensive bags for collection of toner debris. The gate is hinged to permit easy opening by a controller and motor. The controller turns off any pressure while the gate is open. The drop gate conveys when open waste toner from an upper waste collection funnel to the collection bag.

13 Claims, 4 Drawing Sheets

WASTE CYCLONE DISPENSE SYSTEM WITH A CONTROLLED GATE

This invention relates to an electrophotographic marking system and, more specifically, to a toner waste collection assembly.

CROSS REFERENCE TO RELATED APPLICATIONS

Illustrated and disclosed is a co-pending U.S. patent application Ser. No. 12/572,308 owned by the present assignee and relating to a gate having rotating blades that is positioned above a toner collection bag and that conveys waste toner to the collection bag. This present application and U.S. patent application Ser. No. 12/572,308 were filed on the same date. The disclosure of U.S. patent application Ser. No. 12/572,308 is totally incorporated by reference into the present disclosure.

BACKGROUND

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge therein in the irradiated areas. This records an electrostatic latent image on the photoconductive member corresponding to the informational areas contained within the original document. After the electrostatic latent image is recorded on the photoconductive member, the latent image is developed at a developer station by bringing a developer material into contact therewith. Generally, the developer material is made from toner particles adhering triboelectrically to carrier granules. The toner particles are attracted from the carrier granules to the latent image forming a toner powder image on the photoconductive member. The toner powder image is then transferred from the photoconductive member to a copy sheet. Heat is applied to the toner particles to permanently affix the powder image to the copy sheet. Often, residual toner remains in the developer station and the cleaning station. This residual toner is generally passed to a toner waste dispensing assembly or container where it is passed outside the marking system.

This excess or residual toner is eliminated from the machine and waste toner is collected in a waste toner container. The waste toner container is then removed when filled and disposed of. In color systems waste toner cannot be reused because of the plurality of colored toner in the waste mix.

Some xerographic or electrophotographic machines exhaust waste dry ink (toner) at a rate of approximately 320 grams/hour (actual rate varies with job area coverage, stock size, toner aging purge parameters and manifold emissions). At this rate, a currently-used waste dry ink container has to be replaced approximately every 28 hours. Furthermore, the waste container has stringent strength requirements: sustain 6 inches wg vacuum pressure and hold 20 lb. weight.

Because of the high waste rate and stringent strength requirements, a very expensive plastic container is currently used in several machines. The high replacement rate leads to about 35 tons of plastic waste per year per machine. The disposal of these plastic containers poses an environmental problem in the prior art.

Designing a simpler waste cyclone dispense system would make the electrophotographic marking apparatus a greener machine by reducing plastic waste in the landfill. It would also reduce the piece part cost of a high replacement item.

SUMMARY

This invention proposes an alternative to eliminate the continued vacuum pressure requirement on the current waste dry ink container. Using a hard, thick plastic container will no longer be necessary. By using a controller that turns off the vacuum when the controlled gate is opened and the collecting bag is being removed. The necessity of a rigid-strong pressure resistant plastic collection container of the prior art is avoided. In one embodiment, the gate will be motor driven to open the gate and shut it once every hour or at set periods of time. Software is provided in the controller to open and close the gate every time the marking system boots up. In place of this expensive plastic collection container, a substantially less expensive collection, environmentally friendly, disposable bag can be used. The cyclone separators in the system no longer apply a continuous 6 inch wg vacuum pressure on the bag waste container of this invention since the controller turns the vacuum pressure off at set intervals. This invention proposes the use of a controlled gate to assist the collection in a bag and not require the waste container suction of the cyclone separators. The vacuum pressure is only maintained in the collection assembly before the controlled gate begins to convey the waste via the bag opening. This feature will be described in detail in the drawings of this disclosure.

This invention provides a toner collection assembly to replace the rigid and expensive waste collection containers of the prior art. The requirements of high fill rate and mass and internal vacuum in the prior art lead to frequent replacement of a thick plastic container. In the present invention, a waste assembly is provided that eliminates the requirement to sustain a continuous vacuum by using a controlled gate that acts at atmospheric pressure. This allows an inexpensive thin-walled, disposable container or bag to be used. This invention provides a cheaper, flimsier bag container that can be used when used without any vacuum pressure. Toner would be allowed to pile up above the gate, and then it would drop into the container when the pressure is turned off and the controlled gate is periodically opened.

While the collection container will be described herein as a "bag", other inexpensive collection containers may be used, if suitable, such as degradable boxes or other degradable paper or plastic collectors. These are included in the term "bag" as used in this disclosure. The bags used are in one embodiment similar to bags used in vacuum cleaners. The collection system or assembly of this invention is particularly well suited for color multiple station marking systems but obviously can also be used in monochromatic marking systems.

The collection bag of the present invention can easily be retrofitted into those existing toner waste collection stations presently being used. It is important that the bags used be UL approved or have similar private or governmental approval and acceptance. Any other suitable controlled gates or toner conveyors may be used to deposit waste toner in the bag provided they can replace the thick plastic collection container and can eliminate the system vacuum as the controlled gate is opened.

DETAILED DISCUSSION OF DRAWINGS AND PREFERRED EMBODIMENTS

Figure 1:
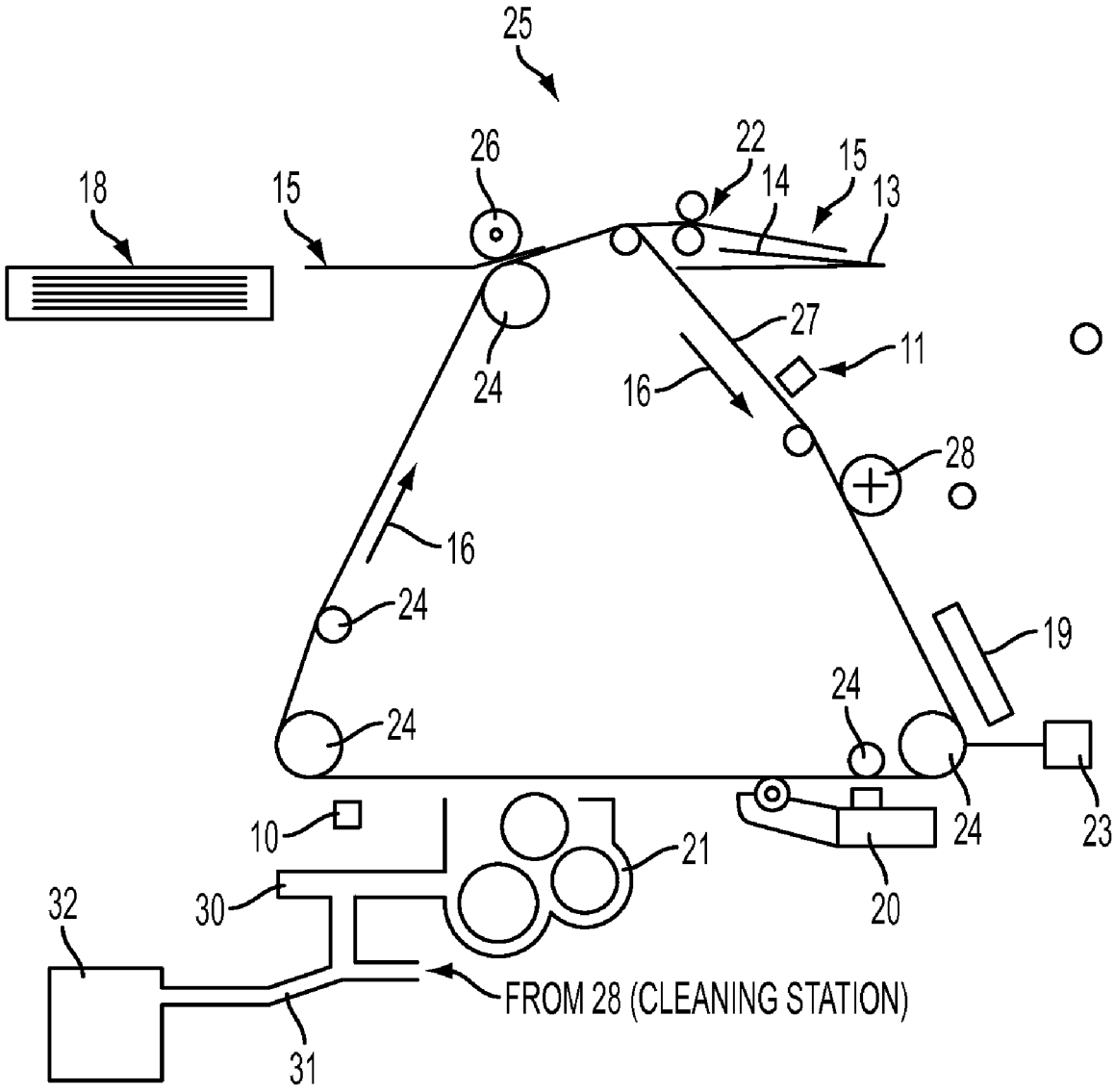
FIG. 1 is a schematic view of an electrophotographic marking system that can utilize the toner collection assembly of the present invention.

In FIG. 1, a monochromatic electrophotographic marking system is shown for simplicity and ease of understanding. It should be noted, however, that multi-station color systems using from 4-6 units of xerographic system 25 illustrated in FIG. 1 are within the scope of this invention. While both monochromatic and multi-unit color systems are within this invention, use of the toner waste collection assembly 29 of this invention is most beneficial in multi-unit color systems where 4-6 different colored toners are used and much more toner waste occurs. In FIG. 1, the following numbers are used to designate the following xerographic system components.

In FIG. 1, the following are illustrated:

10. sensor
11. sensor
13. stacking assembly
14. collection station
15. paper
16. arrows of belt movement
18. paper feed
19. charging station
20. exposure station
21. developer station
22. fusing station
23. motor
24. rollers
25. xerographic system
26. transfer station
27. photoconductor belt
28. cleaning station In developer station 21 and in cleaning station 28 where excess toner occurs, waste housing 30 accumulates waste toner and other debris and transports it via collection tubes 31 to the waste collector 32 of this invention. While FIG. 1 only shows one waste housing 30 and collection tubes 31, multiple xerographic developer stations of a color system will have multiple waste housings 30 and multiple collection tubes 31 (as shown in FIG. 4 herein). Multiple xerographic units and a typical color system are illustrated in U.S. application Ser. No. 12/189,379 which is incorporated by reference into the present disclosure. For clarity, the specifics of waste collector 32 of this invention are not shown in FIG. 1 but are shown in detail in FIGS. 3 and 4.

Figure 2:
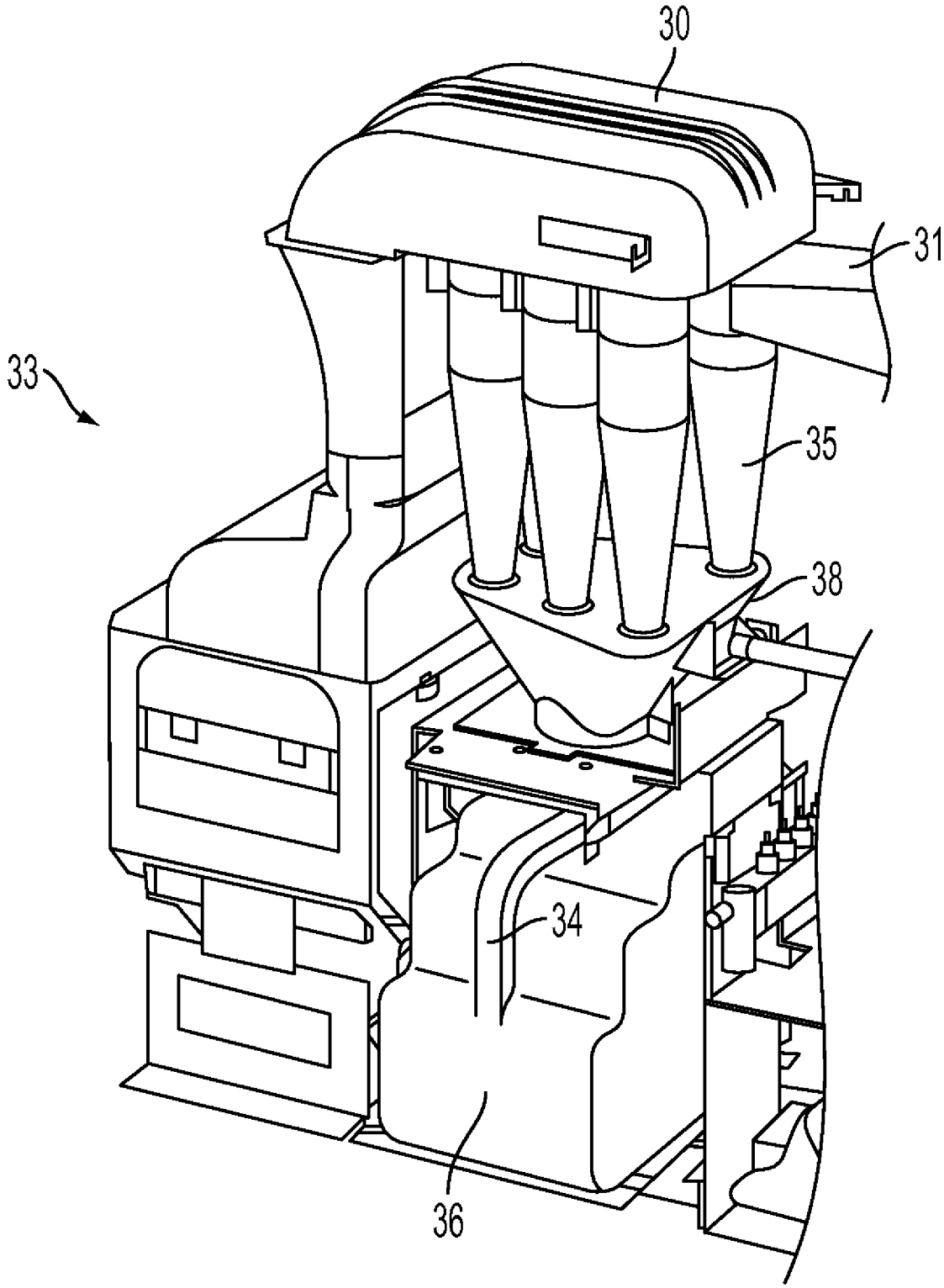
FIG. 2 PRIOR ART
FIG. 2 is a front view of a prior art waste toner collection apparatus using a hard thick plastic collection container.

In FIG. 2, a collection unit 33 of the prior art is shown where a prior art waste dry ink or toner container 36 is used with a removal handle 34. Here the cyclone separators 35 apply a vacuum pressure on the rigid waste container 36. A typical prior art marking system exhausts waste dry ink (toner) at a rate of approximately 320 grams per hour. At this rate, the current prior art waste dry ink container 36 has to be replaced approximately every 28 hours. This prior art waste container 36 has stringent strength requirements such as sustain 6 inches wg vacuum pressure and hold 20 lb. waste. Because of these requirements, a very expensive prior art plastic container 36 is currently being used. The high replacement rate of these prior art containers 36 leads to about 35 tons of plastic waste per year for one family of machines. Providing a simpler waste dispense assembly 32 of this invention would make these machines greener by substantially reducing plastic waste in the landfill. It would also reduce the part price cost of a high replaced item, i.e. container 36. Collection tubes 31 lead to cyclone separators 35, the cyclone separator 15 applies a vacuum pressure on the waste container 36. This vacuum pressure exists also in container 36 which accounts for the necessity of rigidity and thickness in container 36. One of the important advantages of the present waste assembly is that there is no need for vacuum pressure in the collection bag 39 since the rotating cylinder gate 37 seals off the pressure in the upper funnel portion 38 from the bag 39. The bag 39 of the present invention together with rotating cylinder gate 37 replaces prior art rigid container 36. The prior art container 36 when filled is pulled out of the prior art assembly 33 and discarded in a landfill, thereby causing some pollution concerns.

Figure 3:
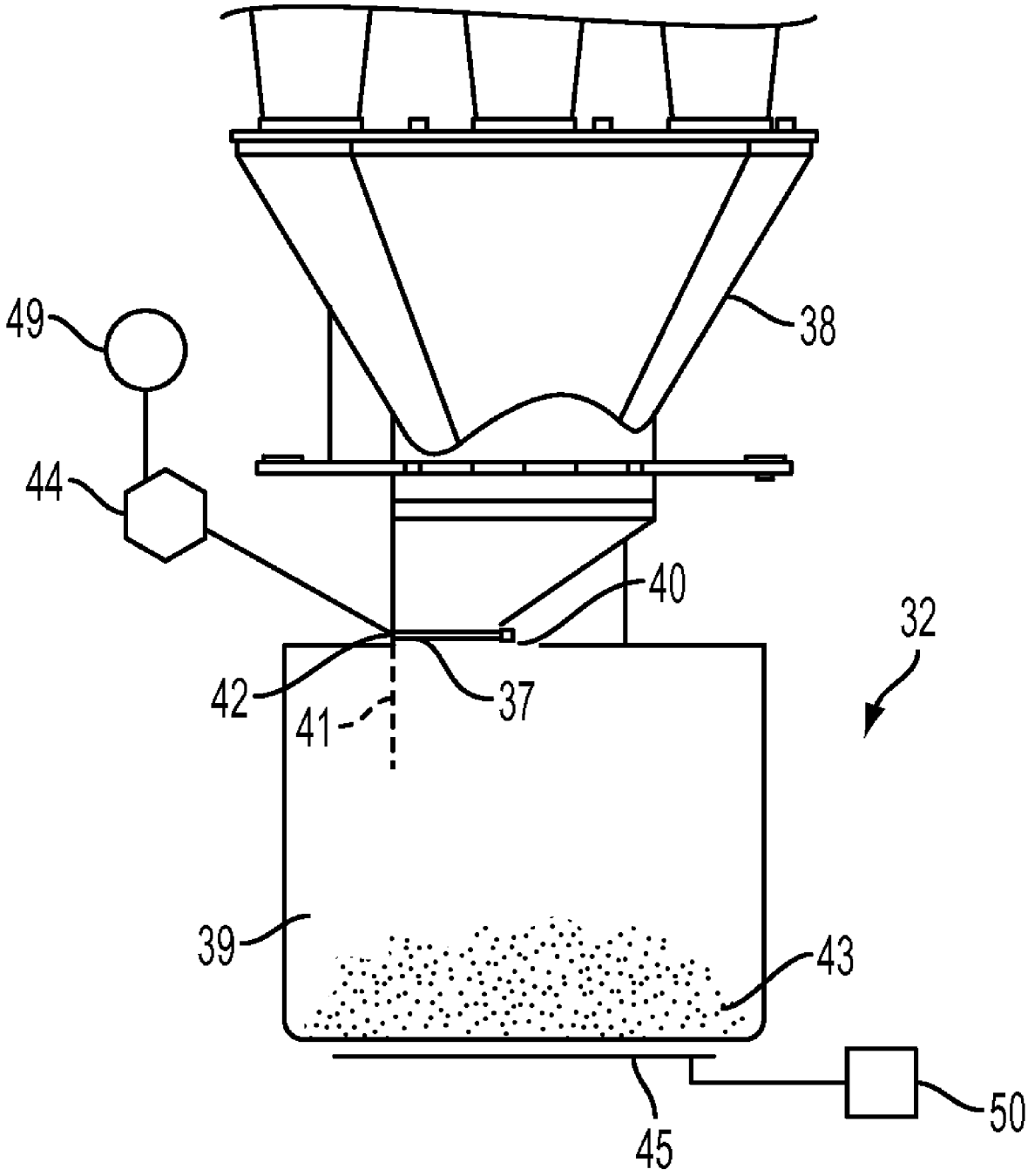
FIG. 3 is a front schematic of the collection assembly of the present invention using a degradable collection bag and a controlled drop gate through which waste toner passes into the collection bag.
Figure 4:
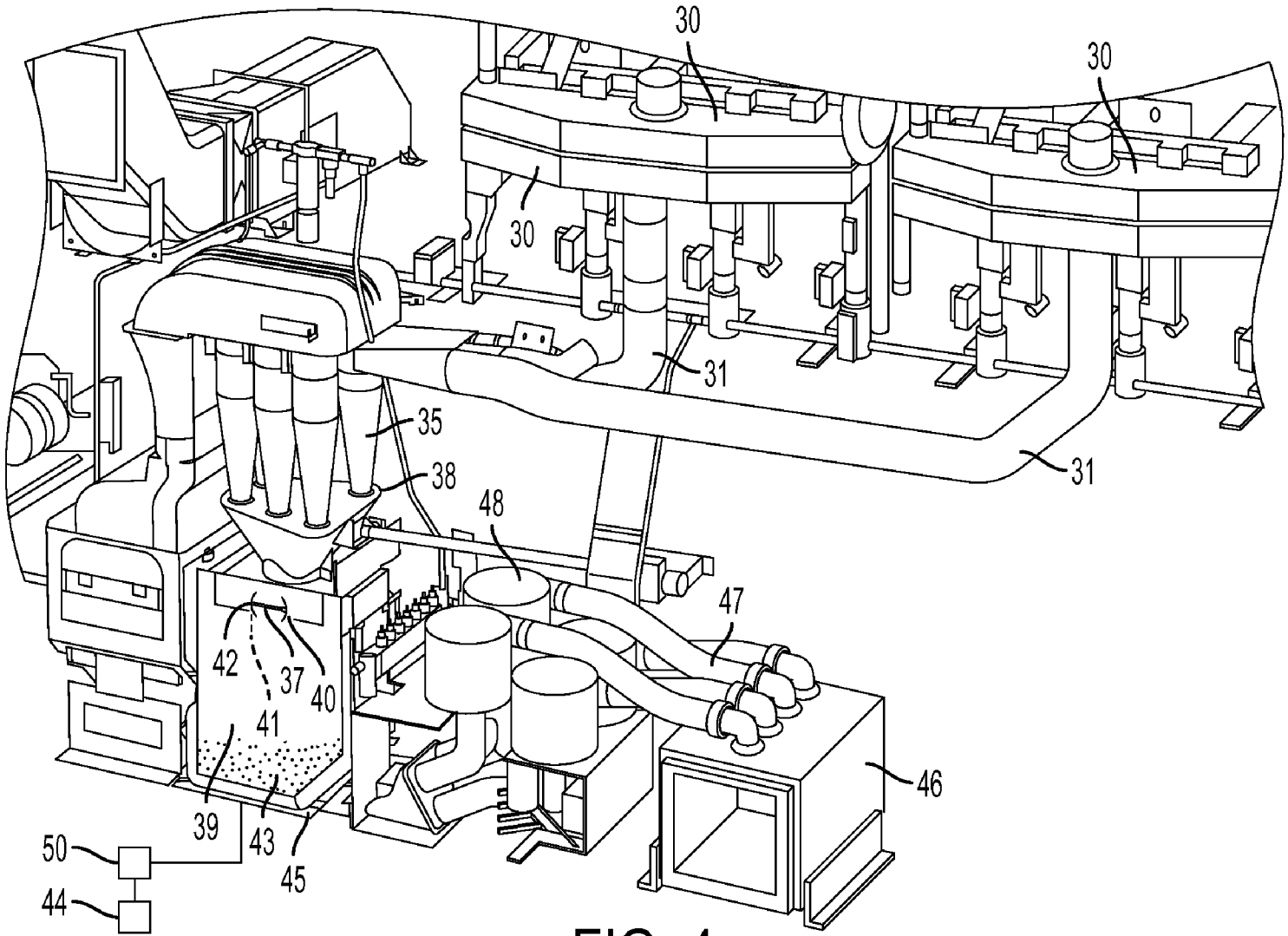
FIG. 4 is a perspective view of the collection assembly of this invention as it is connected to the developer stations of an electrophotographic marking system.

In FIG. 3, a part of the waste collection assembly 32 of this invention is shown where a bag 39 with an opening 40 is used in place of the expensive prior art plastic container 36. The controlled drop gate 37 seals off the pressure in upper unit funnel portion 38. The controlled gate 37 of this invention which is controlled by controller 44 and motor 49 to open as shown by dotted lines 41 and let toner waste 43 dump into the lower collection bag 39. As the controlled drop gate 37 opens on hinge 42, it allows an amount of waste toner 43 to drop into bag 39. Once the gate 37 opens, the controller 44 automatically turns off the vacuum which prevents any pressure from entering the bag 39. The gate 37 is connected to a controller 44 and motor 49 and the gate 37 has a blade that is controlled thereby to open (or close) and let waste toner and debris 43 to dump into the lower non-pressurized bag 39. The pressure is turned back on once the filled bag 39 is removed and a new bag replaces it. A weight scale 45 is positioned under bag 39 and via sensor 50 tells the controller 44 when the bag 39 is full and needs replacing. In the embodiment shown in FIG. 3, the motor 49 is driven to open the gate 37 and shit it at a fixed time, for example, every hour. Software is provided in the controller 44 to open and close the gate 37 (via motor 49) every time the marking system boots up.

In FIG. 4, waste housings 30 from different multiple developer stations of a color printer are shown as they are connected to waste collection tubes 31. The tubes 31 transport waste toner 43 from the color developer stations to cyclone separators 35 which fields the waste toner 43 into funnel 38 to controlled drop gate 37 of this invention. The gate 37 opens (dotted lines 41) and carries waste toner 43 into degradable bag 39. Below the bag 39 is a weight scale 45 which indicates when the bag 39 is full of waste toner 43 and needs to be removed and replaced with a new bag 39. This scale communicates with scale sensor 50 and controller 44. This FIG. 4 illustrates a portion of a multi-color xerographic unit having at least two separate development stations connected to waste housings 30 and collection tubes 31. The scale 45 when it reaches a certain fixed weight will contact the controller 44 via sensors 50 and the controller 44 will tell the motor to shut down the loading when the bag 39 is filled. Some components shown in FIG. 4 that do not constitute part of the collection unit of the present invention but are shown for understanding and clarity are air collectors 46 and exhaust tubes 47 and vacuum blowers 48.

In summary, this invention provides a novel toner waste collection assembly and a novel electrophotographic marking system. The electrophotographic marking system comprises a developer station and a cleaning station and these stations comprise a waste toner dispensing unit. The dispensing unit comprises collection tubes that are configured to convey waste toner to a waste collection assembly. This assembly comprises a funnel portion that is configured to feed waste toner to a controlled drop gate that is configured to transport the waste toner to a disposable and decomposable collection bag.

The controlled gate comprises a hinged drop blade that is controlled by a controller and motor to open and close. The marking system comprises a plurality of xerographic structures each having at least one of the collection tubes.

In one embodiment, the system is a color marking system comprising a plurality of color stations; each station comprises at least one collection tube.

In another embodiment, the system is a monochromatic marking system with at least one collection tube. The waste collection assembly is configured to be easily retrofitted into existing electrophotographic marking systems.

The controlled gate of this invention is configured to transport waste toner into a collection bag while the pressure in the collection assembly is turned off by the controller thereby preventing any pressure existing in an adjacent waste collection assembly from entering the collection bag. This is done by turning the pressure off when the gate is open. The toner waste collection assembly of this invention comprises a controller and collection tubes running from an electrophotographic marking system to a toner collection funnel in the assembly. The toner collecting funnel connects the collection tubes to a controlled drop gate. This gate is configured to transport waste toner to a replaceable decomposable collection bag. The controlled, hinged drop gate is fitted below the funnel and is configured when opened or dropped to prevent any assembly pressure from entering the bag because the pressure is automatically turned off by the controller when the gate is open and conveys toner waste into the bag. The collection bag is located on and above a weight scale. This scale is configured to indicate via a sensor when the bag is filled with waste and needs to be replaced. The bag has an opening that is configured to accept waste toner transported by the controlled drop gate.

The waste collection assembly is configured to transport waste toner into a collection bag while at the same time maintaining only atmospheric pressure in the bag. As above noted, the weight scale is positioned immediately below the bag and is configured to indicate the weight of the bag and the toner waste in the bag. A motor shown in FIG. 3 is connected to the controller. The motor is configured to both energize the controlled gate and shut down the gate.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An electrophotographic marking system comprising:

a developer station and a cleaning station, said developer and cleaning stations comprising a waste toner dispensing unit, said waste toner dispensing unit comprising a plurality of collection tubes configured to convey waste toner from said developer and cleaning stations to a waste collection assembly, said waste collection assembly comprising a funnel portion configured to feed waste toner to a controlled drop gate that is configured to transport said waste toner to a collection bag, said controlled drop gate comprising a hinged blade that is connected to a motor and a controller, said controller configured to open said blade at a fixed time or times, to allow waste toner to drop into and be collected by said collection bag, wherein said controlled drop gate transports waste toner into said collection bag while turning off any pressure existing in an adjacent waste collection assembly thereby preventing said pressure from entering said collection bag.

2. The marking system of claim 1 wherein said system comprises a plurality of xerographic stations or structures each having at least one of said plurality of collection tubes.

3. The marking system of claim 1 wherein said system is a color marking system comprising a plurality of color stations, each said station comprising at least one of said plurality of collection tubes.

4. The marking system of claim 1 wherein said system is a monochromatic marking system with at least one of said plurality of collection tubes.

5. The marking system of claim 1 wherein said waste collection assembly is configured to be easily retrofitted into existing electrophotographic marking systems.

6. A toner waste collection assembly comprising a controller, a motor and collection tubes running from an electrophotographic marking system to a toner collection funnel in said assembly, said toner collecting funnel connecting said collection tubes to a controlled drop gate, said controlled drop gate configured to transport waste toner to a disposable and replaceable collection bag, said controlled drop gate comprising a hinged blade that is connected to said motor and controller, said controller configured to opening said blade at a fixed time or times, said opening configured to allow waste toner to drop into said collection bag, wherein said controlled drop gate transports waste toner into said collection bag while turning off any pressure existing in an adjacent waste collection assembly thereby preventing said pressure from entering said collection bag.

7. The assembly of claim 6 wherein said controlled drop gate is configured when in a closed position to prevent toner from entering said collection bag.

8. The assembly of claim 6 wherein said collection bag is located above a weight scale, said scale configured to indicate when said collection bag is filled with waste and needs to be replaced.

9. The assembly of claim 6 wherein said collection bag has an opening configured to accept waste toner transported by said controlled drop gate.

10. The assembly of claim 6 wherein said controlled drop gate is hinged to permit easy opening when toner is to be dropped into said collection bag.

11. The assembly of claim 6 configured to transport waste toner into a collection bag while at the same time maintaining only atmospheric pressure in said collection bag.

12. The assembly of claim 6 wherein a weight scale is positioned below said collection bag and is configured to indicate the weight of said collection bag with said toner waste.

13. The assembly of claim 6 wherein a motor is connected to said controller, said motor configured to both energize said controlled drop gate and shut down said controlled drop gate when instructed to do so by said controller.

* * * * *